United States Patent [19]

Cruse et al.

[11] 4,088,071

[45] May 9, 1978

[54] REFUSE COMPACTOR

[75] Inventors: Harry R. Cruse, Carmichael; Richard I. Copenhagen, Orinda, both of Calif.

[73] Assignee: Pacific Waste Equipment Corporation, Emeryville, Calif. ; by said Richard I. Copenhagen

[21] Appl. No.: 697,135

[22] Filed: Jun. 17, 1976

[51] Int. Cl.[2] ..... B30B 1/18

[52] U.S. Cl. ..... 100/245; 100/52; 100/53; 100/255; 100/256; 100/285; 100/289; 100/295; 214/304; 220/1.5; 220/254; 292/131; 294/73

[58] Field of Search ..... 100/218, 289, 283, 285, 100/286, 287, 256, 52, 53, 45, 48, 240, 245, 229 A, 215, 255, 295; 214/302, 304; 294/68, 71, 73; 220/1.5, 254, 315, 323; 232/43.1, 43.2; 292/131

[56] References Cited

U.S. PATENT DOCUMENTS

| | | | |
|---|---|---|---|
| 891,329 | 6/1908 | Dederick | 100/285 |
| 2,546,892 | 3/1951 | Harman | 220/254 |
| 2,916,985 | 12/1959 | Beach | 100/DIG. 2 |
| 2,951,602 | 9/1960 | Walden | 214/304 |
| 3,011,666 | 12/1961 | Dempster | 214/304 |
| 3,129,657 | 4/1964 | Farley | 100/229 A |
| 3,270,902 | 9/1966 | Breault | 214/302 |
| 3,460,463 | 8/1969 | Jernstrom | 100/289 |
| 3,680,478 | 8/1972 | Beachner | 100/233 |
| 3,687,317 | 8/1972 | Gagel | 214/304 |
| 3,772,984 | 11/1973 | Karls | 100/229 A |
| 3,881,407 | 5/1975 | Goar | 100/229 A |
| 3,945,314 | 3/1976 | Hennells | 100/229 A |
| 3,961,573 | 6/1976 | Schmidt | 100/233 |
| 3,981,436 | 9/1976 | Neal | 232/43.2 |

FOREIGN PATENT DOCUMENTS

| | | | |
|---|---|---|---|
| 341,865 | 7/1936 | Italy | 100/245 |

*Primary Examiner*—Billy J. Wilhite
*Attorney, Agent, or Firm*—Flehr, Hohbach, Test, Albritton & Herbert

[57] ABSTRACT

A refuse compactor with an upright mechanical ram actuated by an electrical power unit interconnected to the ram by a linkage assembly including upright scissor arm pairs. Slots of the compactor container receive the forks of a front loader-type refuse truck. A latching assembly automatically unlatches a dump lid when the forks are fully inserted. A smaller refuse loading lid is provided in the dump lid which is automatically locked when the ram is in motion.

8 Claims, 7 Drawing Figures

REFUSE COMPACTOR

BACKGROUND OF THE INVENTION

The present invention relates to a mechanically actuated refuse compactor.

Refuse compactors have been employed for dry and semi-dry refuse from such sources as apartment buildings. Many of these compactors employ hydraulic rams. However, such hydraulic mechanisms are relatively complex and subject to frequent maintenance problems. Mechanically actuated rams have not been employed successfully. One problem with such rams is that they were not properly supported in the lower containment area of maximum compaction load and so were subject to operational difficulties such as misalignment. Such unsuccessful attempts employed horizontal scissor linkages between the power unit and the ram which were subject to trapping any refuse which slipped behind the ram in the cross-arm of the scissor mechanism.

SUMMARY OF THE INVENTION AND OBJECTS

In accordance with the present invention, the refuse compactor is provided with a mechanically actuated upright ram interconnected with an electrical power unit by a scissor-type linkage assembly. Two pairs of scissor arms are spaced apart and vertically positioned along the back side of the ram at the lower portion thereof to support the maximum compaction load at maximum ram extension. The power is suitably transmitted to the linkage from an electrical motor through a gear reducer and vertical ball screw with a cross-bar interconnected to an upper slidable arm of each scissor pair.

The compactor container includes a large dump lid and a smaller refuse loading lid pivotally mounted to the same. An assembly is provided for automatically unlatching the dump lid in response to insertion of the forks of a front loader dump truck for pivotal unloading of the compactor container. The latch is automatically relocked upon removal of the same forks.

One safety feature of the invention is a latch which locks the loading door to the dump door when the loading door is open or the ram is in an extended position for movement. Also, automatic motor control means is provided to actuate the ram.

It is an object of the invention to provide a refuse compactor which is relatively inexpensive and reliable with low maintenance.

It is a particular object of the invention to provide a compactor of the above type which employs a mechanically actuated ram.

It is a further object of the invention to provide a modular unit comprising the ram and actuating mechanism which is readily removable from the compaction container for servicing.

It is another object of the invention to provide a safety interlock which prevents movement of the ram when the load door is open.

It is another object of the invention to provide a large dumping door and a smaller loading door mounted to the same with a latch that is locked when the dumping door is open or the ram is in an actuated position.

Other features and objects of the invention will be apparent from the following description taken in conjunction with the appended drawings.

DETAILED DESCRIPTION OF THE PREFERRED EMBODIMENTS

Figure 1:
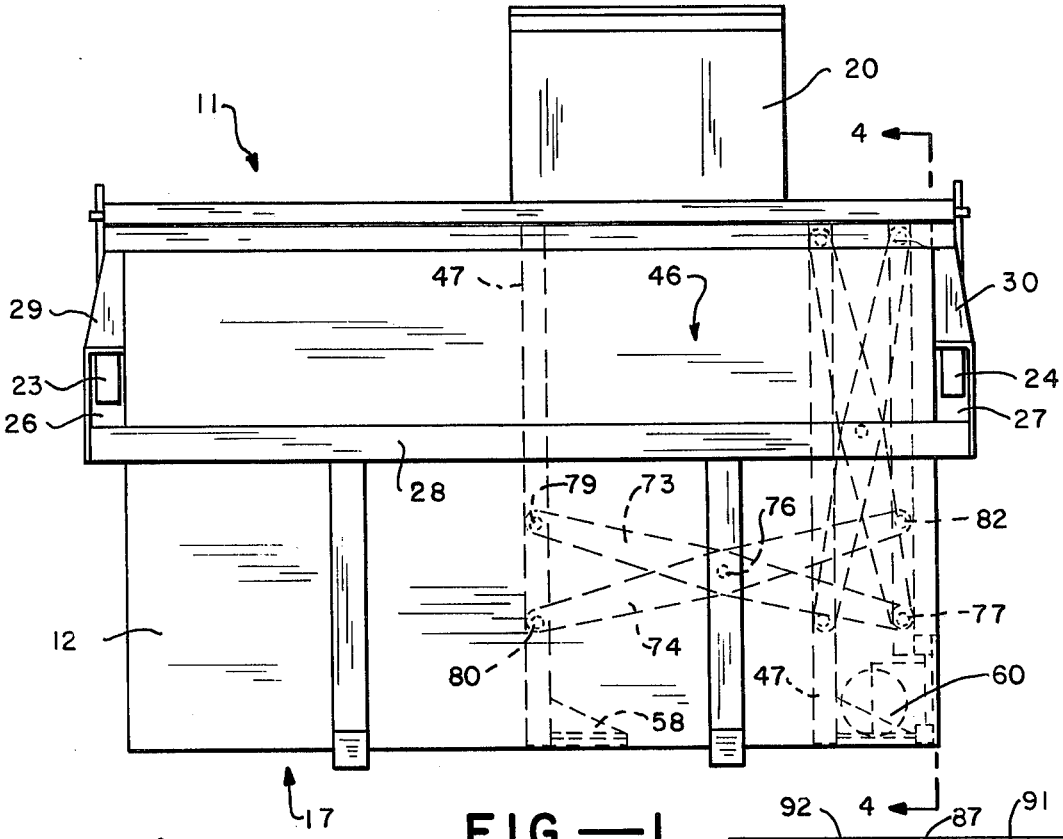
FIG. 1 is a side elevational view of the compactor container illustrating the power unit and ram linkage in phantom in extended and compacting positions with an open load door.
Figure 2:
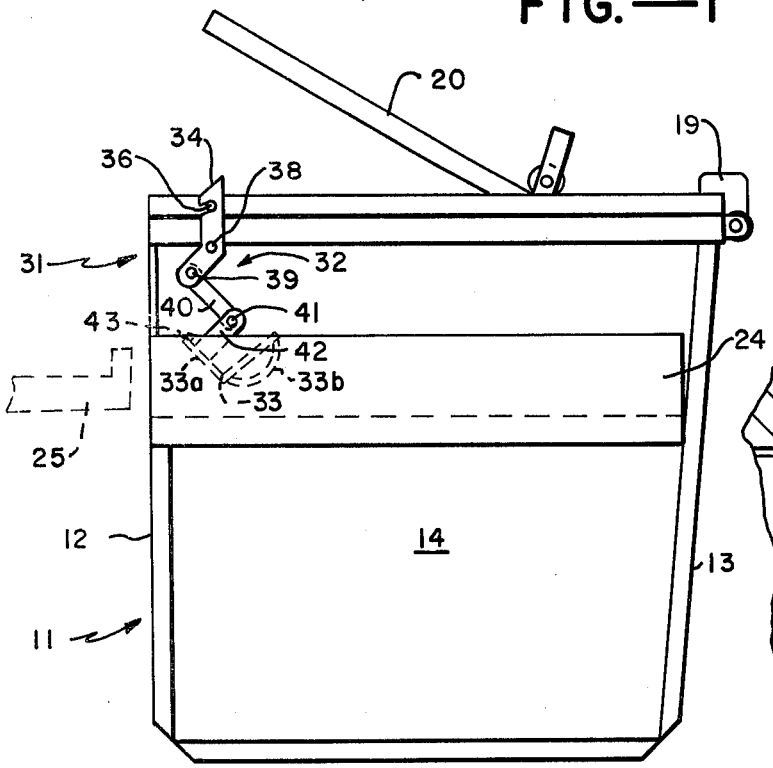
FIG. 2 is an end view of the compactor container of FIG. 1 illustrating the dump lid latch mechanism.
Figure 3:
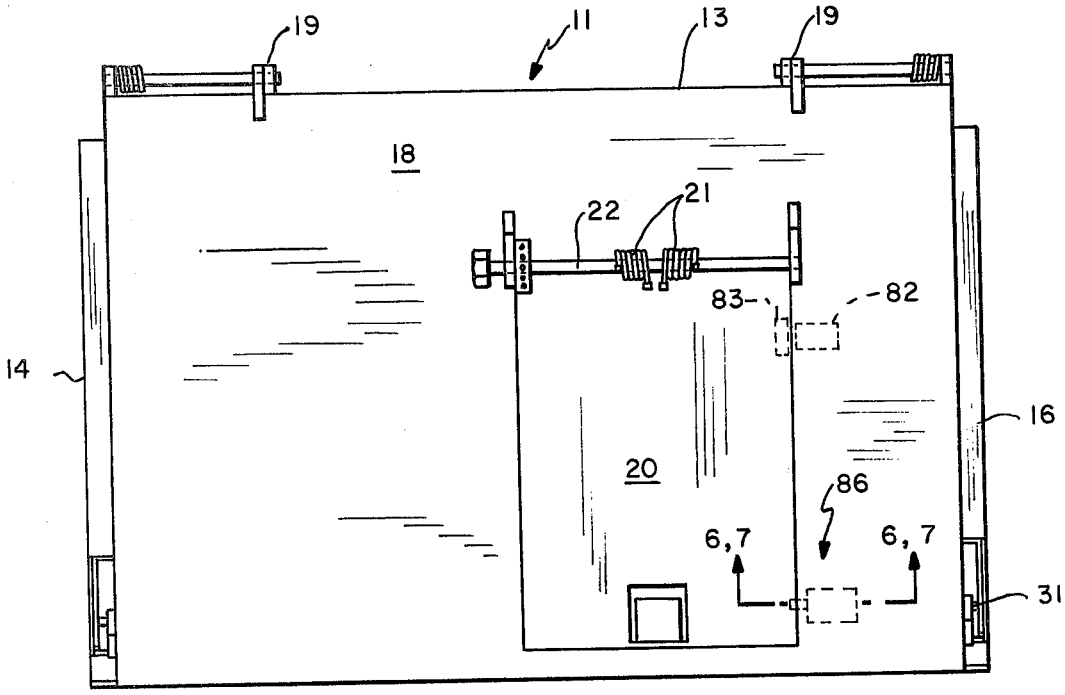
FIG. 3 is a top view of the compactor container of FIG. 1.

Referring to FIGS. 1, 2, and 3, a compaction container generally designated 11 is illustrated with a front wall 12 and an opposing rear wall 13, opposing end walls 14 and 16, and a bottom wall 17. A dump lid 18 is pivotally mounted to the top surface of container 11 by hinges 19. A refuse loading lid 20 substantially smaller than dump lid 18 is spring loaded to an opening in the dump lid by adjustable springs 21 which assist opening by pivotal movement about pivot bar 22. Such spring loading permits the raising of loading lid 20 with relatively small effort by a person loading the container with refuse.

The container of the present invention is of a type which is suitable for a front loader truck. Such trucks include spaced parallel lifting forks actuated by a tilt hoist for pivoting the container over the truck. The parallel forks are received in means forming parallel spaced opposing slots 23 and 24 mounted to end walls 14 and 16, respectively. Referring to FIG. 2, one lifting fork 25 is illustrated in phantom adjacent to slot 24. Referring to FIG. 1, such means may be formed of horizontal U-shaped members 26 and 27 firmly secured to a cross-brace 28. Protective plates 29 and 30 are mounted to front wall 12 above slots 23 and 24, respectively and serve as barriers to prevent lifting forks which may not be aligned properly from damaging the latching mechanism located behind the plates.

A latching assembly generally designated by the number 31 is provided to latch dump lid 18 to container 11. Assembly 31 may be actuated to a latch release position by the insertion of the lifting forks 25 from a tilt hoist for pivoting the container over the truck. Upon removal of the lifting forks, assembly 31 returns to its latched position.

Latching assembly 31 comprises latching member 32 with a bearing extension 33 at one end and a hooking member 34 at the other end. Latching is accomplished by engagement of hooking member 34 with a suitable cooperating member mounted to the dump lid such as pin 36. Bearing extension 33 projects into slot 24 into the line of travel of lifting forks 25. Bearing extension member 33 is suitably V-shaped with a relatively flat front bearing surface 33*a* and a rounded rear bearing surface 33*b*. Hooking member 34 is pivotally mounted to fixed pivot point 38 and includes a free pivot point 39 interconnected by arm 40 to free pivot point 41 which, in turn, is rigidly connected by arm 42 to extension member 33. One end of extension member 33 is pivotally mounted to a fixed pivot point 43.

To summarize the foregoing, hooking member 34 is interconnected by a floating linkage to bearing extension member 33. In this manner, upon insertion into slot 24, forks 25 bear against surface 33*a* to pivot the same about pivot 43 to disengage hooking member 34 from pin 36 and so to unlatch dump lid 18. Thus, after insertion of the lifting forks from the tilt hoist, container 11 is pivoted over the truck and dump lid 18 is automatically opened for dumping of the contents of the container. This avoids the time consuming requirement for the truck operator to exit the cab of the truck to lock and unlock manually the dump lid latch.

An opening is provided in the top of U-shaped member 26 to accomodate latching assembly 31. Also a latching assembly 43 identical to assembly 31 may be provided for slot 23.

Figure 4:
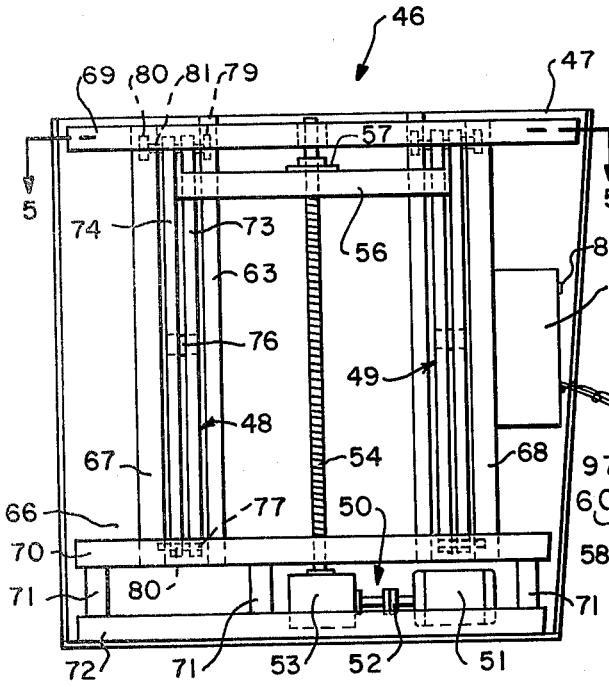
FIG. 4 is a view taken along the line 4—4 of FIG. 1 illustrating the ram back side, linkage, and power mechanism.
Figure 5:
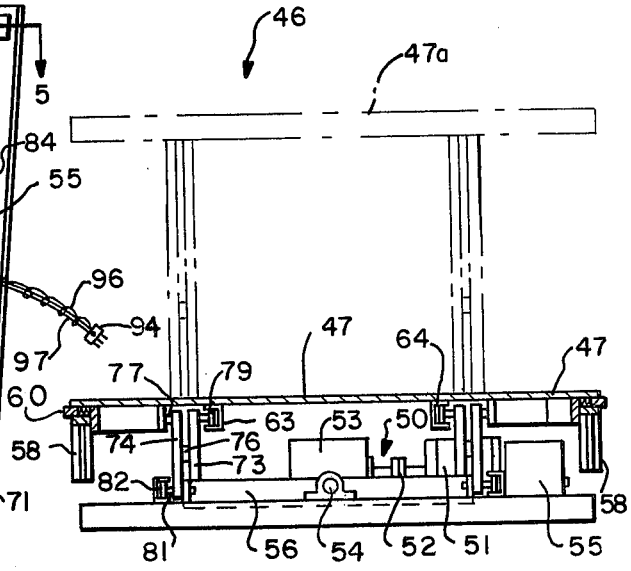
FIG. 5 is a cross-sectional view taken along the line 5—5 of FIG. 4.

Referring to FIGS. 4 and 5, a mechanically actuated ram assembly is illustrated generally designated by the number 46 which includes ram 47, spaced vertical scissor pair linkage assemblies 48 and 49 and a power unit 50 for actuating linkage assemblies 48 and 49. Referring to FIG. 5, ram 47 is actuated from a first retracted position 47, illustrated in solid lines, and a second extended position 47*a* for refuse compaction, illustrated in phantom. For purposes of the present description, the parts of ram assembly 46 and the retracted position of the same will be designated by numerals only while the extended position will be specified by the same number followed by the letter "*a*".

Power unit 50 includes an electrical motor 51 suitably rated at 1HP, single phase 110v, 1800 RPM. Motor 51 is interconnected by coupling 52 to differential gear box 53 (Winsmith Model 200, 10:1 reduction) which provides a worm gear rotational drive to ball screw 54 (1 inch O.D. and 0.25 inch lead) which passes through a bearing mounted to the support frame. Motor control means comprising motor control box 55 is mounted adjacent motor 51 serving to switch the motor on or off as set forth below. A horizontal cross-bar 56 includes a rigidly bolted internally threaded nut 57 which mates with lead screw 54 to move cross-bar 56 in an upward or downward direction depending upon the rotational direction of the lead screw. Cross-bar 56 includes upwardly extending portions with openings for roller shafts each of which interconnects with one of linkage assemblies 48 and 49.

Ram 47 comprises an upright essentially vertical plate mounted for sliding movement between a retracted position 47 and extended position 47*a*, respectively, illustrated in FIG. 1. Ram 47 is suitably formed of a strong structural steel material. To facilitate sliding movement of ram 47, spaced low friction shoes 58 are provided to support the lower edge of the ram including a low friction surface bearing against the container formed of a suitable low friction plastic material.

Means is provided to prevent solids in the loaded area of the compartment from moving behind the ram into the power mechanism and linkage area. Such means suitably comprises resilient spring loaded flexible wiper blades 60 along the vertical side edges and the bottom edge of ram 47 which are urged into contact with the inner surface of container 11. Such wiper blades retain essentially all of the refuse on the compaction chamber side of the ram.

The ram back surface includes two upright elongate guide means comprising U-shaped angle iron members 63 and 64 forming vertical slots accomodating the rollers of linkage assemblies 48 and 49, respectively, as described hereinafter. The spacing of guide means 63 and 64 is selected to provide maximum structural strength to prevent buckling of ram 47 during maximum compaction.

Scissor-type linkage assemblies 48 and 49 are identical of construction and function. For simplicity of description, only assembly 48 will be described herein. Linkage assemblies 48 and 49 interconnect ram 47 and a frame assembly 66 which supports the rear side of linkage assemblies 48 and 49 as well as the entire power unit 50. Frame assembly 66, linkage assemblies 48 and 49, and ram 47 are constructed of sufficient rigidity so that they may be removed as a modular unit through an open dump lid for maintenance and repair, if necessary. Frame assembly 66 comprises spaced upright members 67 and 68 interconnected to horizontal upper and lower cross members 69 and 70. Member 70 is in turn connected by vertical support bars 71 to base member 72. Power unit 50, motor 51, coupling 52, gear box 53, and control box 55, are rigidly supported to the lower portion of the frame assembly 66 which is removably bolted to the sidewall of container 11.

Referring to FIGS. 1, 4, and 5, linkage assembly 48 comprises cross arms 73 and 74 pivotally mounted by linking pin 76 at intermediate central locations of each arm. The lower end of arm 73 is pivotally mounted at a fixed position to fixed bolt 77 mounted to upright frame member 67. The opposite movable end of arm 73 includes a rotatable roller 79 which is free to roll in the vertical slot of the upright member 63 at the back of ram 47.

Arm 74 is pivotally mounted to fixed bolt 80 at the lower terminus of the slot in member 63 in back of ram 47. The opposite end of arm 74 includes an opening to support a roller pin 81 and a roller 82 which rides in a vertical guide slot of frame member 67. Pin 81 extends through a vertical extension of cross bar 56. In this manner, raising or lowering of cross bar 56 produces a corresponding raising or lowering of the upper end of arm 74 and corresponding extension or retraction movement of ram 47.

The vertical location of the ends of arms 73 and 74 supported against the back side of ram 47 is precisely selected to provide maximum support in the area of maximum load at full extension. Since such load will generally be located in the lower portion of compactor container 11, both the upper and lower ends of arm 73 and 74 of linkage assemblies 48 and 49 are located in the lower portion of the ram back side below the center of the ram. The lower end of arm 74 is substantially above the bottom of ram 47 to prevent uneven stress at the bottom of the ram. Similarly, the slots of members 63 and 64 are located at areas of equal pressure distribution along the ram back side.

Referring to FIG. 1, the linkage mechanism is illustrated with the ram in a retracted position with the scissor arms of the linkage in their most vertical position. At this point, cross bar 56 is at the top of its guide path and ram 47 is located to the right side of loading lid 20 in FIG. 1 to prevent refuse being loaded from falling behind the ram. When motor 51 is turned on, lead screw 54 is rotated in a direction to slowly move cross arm 56 downwardly together with the upper end of arm 74. This translates motion to slide ram 47 toward an extended position by pivotal movement of the upper end of arm 73 until the linkage mechanism reaches maximum extension for maximum compaction as illustrated in phantom in FIG. 1. An important feature of the illustrated vertical disposition of the scissor arms rather than horizontal position is that if any refuse should pass in back of the ram it would not be significantly impeded by the arms upon dumping.

Control means including electrical control box 55 is provided to automatically actuate and deactuate power unit 50 to move ram 47 in a forward or reverse position or stop it. An external two-way switch, suitably in the form of a two-way key lock 84 is mounted to control box 55 and is interconnected by electric circuitry to motor 51. An opening is provided in the back wall of container 11 for access to lock 84. The switch includes off and automatic positions. A magnetic switch 82 is disposed in dump lid 18 and the actuating magnet 83 is disposed in loading lid 20, to form part of the circuit.

When lock 84 is in an automatic mode, opening and closing of loading lid 20 completes the electric circuit through magnetic switch 82 and transmits a signal to control box 55 which actuates motor 51 to commence the cycle of ram 47 from a retracted toward a refuse compacting position. At maximum extension, a limit switch is reached and a signal is transmitted to control box 55 which automatically reverses motor 51 and the direction of screw 54 to move ram 47 back to a retracted position. At full retraction, another limit switch signals control box 55 to turn motor 51 off.

Another feature of the power unit is that a centrifugal sensing device is provided for motor 51 which senses a motor load in excess of a predetermined safe peak level during compaction for reasons such as the presence of excess refuse. This sensing is signaled through the control box to automatically reverse the direction of motor 51 to retract ram 47 to prevent motor damage.

An important safety feature of the power unit is that the ram will not operate with loading lid 20 in an open position. This is accomplished because opening of the lid 20 separates magnetic switch 82 from the actuating magnet 83 to break the ciruit. It would be inconvenient for a curious onlooker to override such a magnetic switch.

Another feature of the power unit is that if the ram cycle is interrupted by breaking the circuit for any reason, as by disconnecting power, the ram cycle will be completed upon reactivating the circuit.

Figure 6:
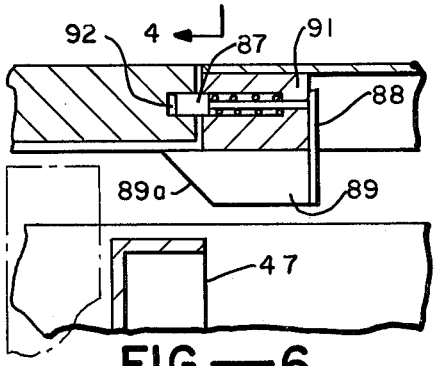
FIGS. 6 and 7 are expanded cross-sectional views taken along the line 6—6, and 7—7, respectively, of FIG. 3 illustrating the loading door latch mechanism.
Figure 7:
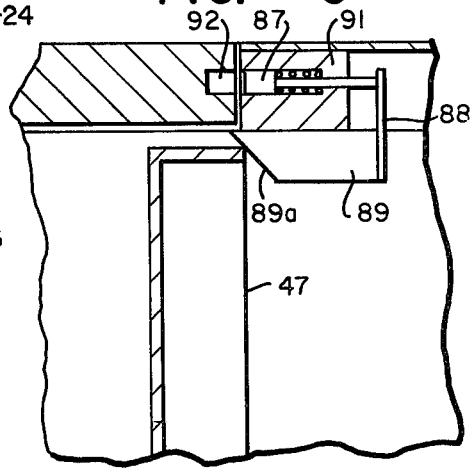

Another important safety feature of the present invention comprises latching means generally designated by the numbr 86 illustrated in phantom in FIG. 3 and in an expanded view in FIGS. 6 and 7. Latching means 86 includes means for locking the same responsive to movement of the ram to its extended position. The latching means comprises the plug or pin 87 spring mounted to arm 88 which interconnects with bearing member 89 which includes a sloped bearing surface **89*a*. Pin 87 is resiliently mounted for sliding movement in a bore of block 91 mounted to the underside of dump lid 18. Loading lid 20 includes a cylindrical recess 92 aligned with pin 87 for seating the same in a lid locking position as illustrated in FIG. 6**.

It is apparent from FIG. 7, that bearing surface **89*a* is disposed in the line of travel of the vertical edge of ram 47. Surface 89*a* is located in a position that when ram 47 is in a fully retracted position, it bears against that surface and moves bearing member 89 and spring loaded pin 87 out of engagement with recess 92 to unlock the latching means. It is apparent that when dump lid 18 is closed, latching means 86 is set in a locked position at all times except when ram 47** is in a fully retracted position. This prevents opening of the loading door during the time when the ram is in movement, an important safety feature.

Latching means 86 also serves to lock loading lid 20 to dump lid 18 whenever the dump lid is opened, regardless of the position of ram 47. This prevents undesirable disengagement of the loading lid from the dump lid during the dumping operation. This feature is apparent by reference to FIG. 7. When dump lid 18 is being rotated to an open position, bearing surface 89 is moved out of contact with ram 47 regardless of the position of the ram. This automatically causes spring loaded pin 87 to be seated in recess 92. When the loading lid is closed and the ram is in a fully retracted position, the bearing surface **89*a* is again contacted with the ram to cause an unlocking of latching means 86 to again permit loading of refuse through lid 18**.

An electrical plug 94 is provided with a spiral cord 96 to supply electricity to the power unit. Cord 96 is wound about a flexible strong cable 97. The plug is normally seated in an electrical socket of a wall adjacent the compactor. The cable and cord are of sufficient strength and flexibility to be pulled from the socket repeatedly without damage during the dumping operation. After dumping, the plug is manually inserted into the socket.

What is claimed is:

1. A refuse compactor comprising, (a) a compaction container, (b) a mechanically actuated ram comprising an upright plate mounted for sliding movement between an extended position for compaction and a retracted position disposed in the compaction container, (c) an electrical power unit for actuating said ram disposed in the compaction container, (d) first upright elongate guide means proximal to said power unit, (e) second upright elongate guide means on the back side of said ram, (f) linkage means comprising at least one upright scissor pair connection mounted between the back side of said ram and said power unit for sliding said ram between its extended and retracted positions in response to actuation of said power unit, said scissor pair including a first arm with a fixed end pivotally mounted at a lower position of said ram back side and an opposite free end mounted for movement in a path along said first guide means, and a second arm with a fixed end adjacent and below said first arm free end in first guide path, the opposite free end of said second arm being mounted for movement in a path along said second guide means above the fixed end of said first arm, said power unit being interconnected with said first arm free end to move it in said first guide means path to actuate movement of said ram between its extended and retracted positions, the ends of said scissor arm pair adjacent the back side of said ram being located in the lower portion thereof at a maximum ram extension to support the maximum compaction load.

2. The compactor of claim 1 togetheer with a second upright scissor pair of the same type as said first pair, said first and second scissor pairs being spaced apart toward the opposing side edges of said ram.

3. The compactor of claim 2 in which said power unit comprises an upright rotatable screw, an electric motor for rotating the screw, a horizontal cross bar with an associated threaded opening through which the screw passes so that the cross bar is raised or lowered in response to screw rotation, the ends of said cross bar being interconnected to the free ends of said first scissor arms so that said ram is moved between said extended and retracted positions in response to screw rotation.

4. The compactor of claim 1 together with wiper blades resiliently mounted to the periphery of said ram in sliding contact with the container side walls adjacent the same to prevent refuse from passing behind said ram.

5. The compactor of claim 1 in which said power unit, linkage means, and ram form part of a modular unit readily removable from said compactor container.

6. In a refuse compactor comprising, (a) a compaction container, (b) a dump lid pivotally mounted at the top of the container adjacent one edge of the same, (c) a mechanically actuated ram comprising an upright plate mounted for sliding movement between an extended position for refuse compaction and a retraction position, (d) a power unit for actuating said ram, (e) means forming spaced parallel opposing slots each having top and bottom interior walls along said container for receiving lifting forks from a tilt hoist for pivoting said container over a front loader-type refuse truck, (f) latching means for said dump lid including a dump lid latched position prior to insertion of said lifting forks into said slots and a latch released position in response to insertion of said lifting forks, said latching means comprising a latching member with a bearing extension surface at one end and a hooking member at the other end, said latching member being pivotally mounted to said container so that in said latched position said bearing extension surface projects into one of said slots in the line of travel of one of said forks and said hooking member engages a cooperating member mounted to said dump lid, and in said released position, said bearing extension surface is pivoted substantially out of said slot by contact with said one fork to pivot said hooking member out of engagement with said cooperating member, said fork directly engaging the top interior slot wall which substantially supports said compaction container during lifting with said latching means in an unlatch released position.

7. The refuse compactor of claim 6 in which said bearing extension surface is mounted to drop back into said one slot under the influence of gravity upon the removal of said one fork from said slot to cause said hooking member to re-engage said cooperating member for relatching.

8. The refuse container of claim 6 in which said bearing extension surface includes a rounded surface.

* * * * *